US008658229B2

(12) United States Patent
Aldridge

(10) Patent No.: US 8,658,229 B2
(45) Date of Patent: Feb. 25, 2014

(54) GUM SLAB PACKAGE HAVING INSERTABLE PRODUCT RETENTION MEMBER

(75) Inventor: Allen Sydney Aldridge, South Orange, NJ (US)

(73) Assignee: Kraft Foods Global Brands LLC, Northfield, IL (US)

( * ) Notice: Subject to any disclaimer, the term of this patent is extended or adjusted under 35 U.S.C. 154(b) by 0 days.

(21) Appl. No.: 13/532,950

(22) Filed: Jun. 26, 2012

(65) Prior Publication Data

US 2012/0263834 A1 Oct. 18, 2012

Related U.S. Application Data

(63) Continuation of application No. 12/707,079, filed on Feb. 17, 2010, now Pat. No. 8,221,812, which is a continuation of application No. 11/124,906, filed on May 9, 2005, now Pat. No. 7,811,614.

(60) Provisional application No. 60/570,014, filed on May 11, 2004, provisional application No. 60/569,926, filed on May 11, 2004, provisional application No. 60/570,016, filed on May 11, 2004, provisional application No. 60/570,019, filed on May 11, 2004, provisional application No. 60/570,020, filed on May 11, 2004, provisional application No. 60/570,017, filed on May 11, 2004, provisional application No. 60/570,129, filed on May 11, 2004.

(51) Int. Cl.
*B65D 81/32* (2006.01)

(52) U.S. Cl.
USPC ..... 426/115; 426/124; 426/106; 426/5; 206/800

(58) Field of Classification Search
USPC ..... 426/115, 124, 106, 5; 206/800
See application file for complete search history.

(56) References Cited

U.S. PATENT DOCUMENTS

| | | | |
|---|---|---|---|
| 183,466 | A | 10/1876 | Pearl |
| 202,210 | A | 4/1878 | Zerban |
| 271,580 | A | 1/1883 | Jones |
| 276,171 | A | 4/1883 | Fraser |
| 329,134 | A | 10/1885 | Brotz |

(Continued)

FOREIGN PATENT DOCUMENTS

| | | |
|---|---|---|
| BE | 417615 | 10/1936 |
| DE | 653242 | 11/1937 |

(Continued)

OTHER PUBLICATIONS

U.S. Appl. No. 60/560,306, filed Apr. 6, 2004, 47 pages (to which a claim of priority is made in 7,527,189; 2005/0218198; 2007/0134371; 2007/0138035; and 2007/0141199.

(Continued)

*Primary Examiner* — Rena Dye
*Assistant Examiner* — Chaim Smith
(74) *Attorney, Agent, or Firm* — Hoffmann & Baron, LLP

(57) ABSTRACT

A package assembly encloses a plurality of individual elongate consumable products. The package assembly includes a plurality of products aligned in a side-by-side array. The package housing enclosed the array of product. The package housing has front and back walls for supporting the products therebetween and a closeable cover for closing a product dispensing opening. The package housing further includes a frictional product retention member insertably supported within the package for frictionally retaining the array of product within the package.

2 Claims, 8 Drawing Sheets

(56) References Cited

U.S. PATENT DOCUMENTS

| | | | |
|---|---|---|---|
| 528,186 | A | 10/1894 | Strakosch |
| 603,872 | A | 5/1898 | Bucklin |
| 624,583 | A | 5/1899 | Vierengel |
| 656,349 | A | 8/1900 | Hilson |
| 732,844 | A | 7/1903 | Gebereux |
| 924,275 | A | 6/1909 | Richardson |
| 1,037,218 | A | 9/1912 | Dirnberger |
| 1,096,909 | A | 5/1914 | Harvey |
| 1,132,781 | A | 3/1915 | Lile |
| 1,144,559 | A | 6/1915 | Mendelson et al. |
| 1,193,423 | A | 8/1916 | Pryor |
| 1,216,259 | A | 2/1917 | Amstrrong |
| 1,253,219 | A | 1/1918 | Dula |
| 1,275,904 | A | 8/1918 | Grotta |
| 1,320,287 | A | 10/1919 | Stern |
| 1,382,459 | A | 6/1921 | Bercovici |
| 1,432,932 | A | 10/1922 | Weis |
| 1,433,439 | A | 10/1922 | Weis |
| 1,469,080 | A | 9/1923 | Goerk |
| 1,490,529 | A | 4/1924 | Dittgen |
| 1,550,966 | A | 8/1925 | Kappes |
| 1,575,420 | A | 3/1926 | Eisenstark et al. |
| 1,625,651 | A | 4/1927 | Gretsch |
| 1,683,651 | A | 9/1928 | Bovard |
| 1,684,381 | A | 9/1928 | Bahr |
| 1,735,325 | A | 11/1929 | L'Enfant |
| 1,751,208 | A | 3/1930 | Kappes |
| 1,755,579 | A | 4/1930 | Grupe |
| 1,763,763 | A | 6/1930 | Denmead |
| 1,805,417 | A | 5/1931 | Ritzel |
| 1,805,418 | A | 5/1931 | Ritzel |
| 1,806,905 | A | 5/1931 | Kampfman |
| 1,824,491 | A | 9/1931 | Molins |
| 1,854,849 | A | 4/1932 | Lerch |
| 1,863,190 | A | 6/1932 | Coulapides |
| 1,864,493 | A | 6/1932 | Bombard et al. |
| 1,865,535 | A | 7/1932 | Meany |
| 1,870,299 | A | 8/1932 | Strelitz |
| 1,871,426 | A | 8/1932 | Schmitt |
| 1,875,197 | A | 8/1932 | Molins |
| 1,895,233 | A | 1/1933 | Rossen |
| 1,906,742 | A | 5/1933 | Coulapides |
| 1,929,148 | A | 10/1933 | Molins et al. |
| 2,008,168 | A | 7/1935 | Bergstein |
| 2,008,361 | A | 7/1935 | Lindsey |
| 2,031,011 | A | 2/1936 | Solon |
| 2,032,661 | A | 3/1936 | Linker |
| 2,039,491 | A | 5/1936 | Nolan |
| 2,042,073 | A | 5/1936 | Rose |
| 2,049,124 | A | 7/1936 | Linderman |
| 2,074,451 | A | 3/1937 | Berberian |
| 2,085,728 | A | 7/1937 | Clark |
| 2,117,281 | A | 5/1938 | Bravi |
| 2,118,849 | A | 5/1938 | Lindsey |
| 2,128,843 | A | 8/1938 | Mullins |
| 2,140,748 | A | 12/1938 | Johanson |
| 2,158,971 | A | 5/1939 | Stratton |
| 2,165,539 | A | 7/1939 | Dahlgren |
| 2,192,472 | A | 3/1940 | Huston |
| 2,192,473 | A | 3/1940 | Huston |
| 2,201,956 | A | 5/1940 | Little |
| 2,208,229 | A | 7/1940 | Ranney |
| 2,210,194 | A | 8/1940 | Baldwin |
| 2,210,195 | A | 8/1940 | Baldwin |
| 2,210,196 | A | 8/1940 | Baldwin |
| 2,212,773 | A | 8/1940 | Gray |
| 2,251,102 | A | 7/1941 | Atterberg |
| 2,258,716 | A | 10/1941 | Ralph et al. |
| 2,263,191 | A | 11/1941 | Saladin et al. |
| 2,268,379 | A | 12/1941 | Bird et al. |
| 2,276,577 | A | 3/1942 | Hahn |
| 2,277,097 | A | 3/1942 | Hansen |
| 2,289,028 | A | 7/1942 | Manko |
| 2,327,301 | A | 8/1943 | Davis |
| 2,343,222 | A | 2/1944 | Nelson |
| 2,379,934 | A | 7/1945 | Seiferth |
| 2,380,367 | A | 7/1945 | Ranney |
| 2,470,388 | A | 5/1949 | Ball |
| 2,497,219 | A | 2/1950 | Haumann |
| 2,547,779 | A | 4/1951 | Renyck |
| 2,563,689 | A | 8/1951 | Muhlhauser |
| 2,578,583 | A | 12/1951 | O'Brien |
| 2,605,897 | A | 8/1952 | Rundle |
| 2,619,092 | A | 11/1952 | Ayers |
| 2,619,226 | A | 11/1952 | Adams |
| 2,682,475 | A | 6/1954 | Smith |
| 2,719,663 | A | 10/1955 | Meyer-Jagenberg |
| 2,744,624 | A | 5/1956 | Hoogstoel et al. |
| 2,755,918 | A | 7/1956 | Gargagliano |
| 2,799,441 | A | 7/1957 | Nerney |
| 2,801,002 | A | 7/1957 | Volckening et al. |
| 2,803,376 | A | 8/1957 | Kampff |
| 2,812,057 | A | 11/1957 | Brownfield |
| 2,820,545 | A | 1/1958 | Bramhill |
| 2,823,798 | A | 2/1958 | Volckening et al. |
| 2,858,060 | A | 10/1958 | Kuchler |
| 2,871,080 | A | 1/1959 | Shelly |
| 2,883,045 | A | 4/1959 | Abramson |
| 2,923,110 | A | 2/1960 | Tamarin |
| 2,933,182 | A | 4/1960 | Davis |
| 2,954,116 | A | 9/1960 | Maso et al. |
| 2,962,161 | A | 11/1960 | Lacy |
| 2,980,240 | A | 4/1961 | Amatel |
| 2,988,209 | A | 6/1961 | Parrilla |
| 3,002,674 | A | 10/1961 | Wright |
| 3,027,998 | A | 4/1962 | Ridgway |
| 3,035,756 | A | 5/1962 | Mullinix |
| 3,047,144 | A | 7/1962 | Wissel |
| 3,069,003 | A | 12/1962 | Amatel |
| 3,071,244 | A | 1/1963 | Doran |
| 3,092,501 | A | 6/1963 | Beck et al. |
| 3,108,711 | A | 10/1963 | Anton |
| 3,113,673 | A | 12/1963 | Stein |
| 3,118,588 | A | 1/1964 | Noble |
| 3,152,694 | A | 10/1964 | Nashed et al. |
| 3,165,249 | A | 1/1965 | Peck |
| 3,187,889 | A | 6/1965 | Sinclair |
| 3,201,258 | A | 8/1965 | Mastella |
| 3,201,536 | A | 8/1965 | Fisher et al. |
| 3,204,759 | A | 9/1965 | Palmer |
| 3,206,094 | A | 9/1965 | Humphrey et al. |
| 3,224,922 | A | 12/1965 | Fry, Jr. |
| 3,225,922 | A | 12/1965 | Straight |
| 3,272,423 | A | 9/1966 | Bjarno |
| 3,282,413 | A | 11/1966 | Sparks |
| 3,322,323 | A | 5/1967 | Greene et al. |
| 3,323,643 | A | 6/1967 | Rush |
| 3,367,552 | A | 2/1968 | Krzyanowski |
| 3,374,884 | A | 3/1968 | Chinkes |
| 3,389,784 | A | 6/1968 | Hendricks et al. |
| 3,389,852 | A | 6/1968 | Egli |
| 3,438,565 | A | 4/1969 | Lugt et al. |
| 3,509,989 | A | 5/1970 | Woll |
| 3,524,583 | A | 8/1970 | Gregory |
| 3,542,191 | A | 11/1970 | Scott |
| 3,580,466 | A | 5/1971 | Thelen |
| 3,583,358 | A | 6/1971 | Hanson, Jr. |
| 3,591,071 | A | 7/1971 | Rosenburg, Jr. |
| 3,623,653 | A | 11/1971 | Work |
| 3,642,564 | A | 2/1972 | Walker et al. |
| 3,664,572 | A | 5/1972 | Puchkoff et al. |
| 3,708,946 | A | 1/1973 | Cahill |
| 3,732,663 | A | 5/1973 | Geldmacher |
| 3,734,280 | A | 5/1973 | Amneus et al. |
| 3,734,801 | A | 5/1973 | Sebel |
| 3,756,385 | A | 9/1973 | Steinbock |
| 3,835,989 | A | 9/1974 | Mori et al. |
| 3,881,649 | A | 5/1975 | Krautsack |
| 3,923,239 | A | 12/1975 | Lee |
| 3,924,739 | A | 12/1975 | Gravesteijn |
| 3,938,655 | A | 2/1976 | Romolt |
| 3,966,045 | A | 6/1976 | Perdue |
| 3,991,168 | A | 11/1976 | Richards et al. |
| 4,015,770 | A | 4/1977 | Tamarin |

(56) References Cited

U.S. PATENT DOCUMENTS

| | | | |
|---|---|---|---|
| 4,053,049 | A | 10/1977 | Beauvais |
| 4,101,024 | A | 7/1978 | Furuya et al. |
| 4,119,196 | A | 10/1978 | Flaherty |
| 4,125,189 | A | 11/1978 | Fujimoto et al. |
| 4,131,195 | A | 12/1978 | Worrell, Sr. |
| D250,748 | S | 1/1979 | Leger |
| 4,142,635 | A | 3/1979 | Capo et al. |
| 4,192,420 | A | 3/1980 | Worrell, Sr. et al. |
| 4,197,949 | A | 4/1980 | Carlsson |
| 4,216,898 | A | 8/1980 | Davies |
| 4,234,084 | A | 11/1980 | Hutten |
| 4,260,061 | A | 4/1981 | Jacobs |
| RE30,616 | E | 5/1981 | Hofer |
| 4,294,353 | A | 10/1981 | Focke et al. |
| 4,360,106 | A | 11/1982 | Irvine et al. |
| 4,377,235 | A | 3/1983 | Carver |
| 4,411,365 | A | 10/1983 | Horikawa et al. |
| 4,436,205 | A | 3/1984 | Horii |
| 4,441,611 | A | 4/1984 | Sommariva |
| 4,464,154 | A | 8/1984 | Ljungcrantz |
| 4,470,508 | A | 9/1984 | Yen |
| 4,546,875 | A | 10/1985 | Zweber |
| 4,552,269 | A | 11/1985 | Chang |
| 4,637,544 | A | 1/1987 | Quercetti |
| 4,666,040 | A | 5/1987 | Murata |
| 4,679,693 | A | 7/1987 | Forman |
| 4,738,359 | A | 4/1988 | Phillips, Jr. |
| 4,850,482 | A | 7/1989 | Campbell |
| 4,874,096 | A | 10/1989 | Tessera-Chiesa |
| 4,902,142 | A | 2/1990 | Lammert et al. |
| 4,949,841 | A | 8/1990 | Focke et al. |
| 4,961,496 | A | 10/1990 | Focke et al. |
| 4,997,082 | A | 3/1991 | Durocher |
| 5,029,712 | A | 7/1991 | O'Brien et al. |
| 5,078,509 | A | 1/1992 | Center et al. |
| 5,080,227 | A | 1/1992 | Focke |
| 5,092,465 | A | 3/1992 | Weder et al. |
| 5,096,113 | A | 3/1992 | Focke |
| 5,123,589 | A | 6/1992 | Cote |
| 5,125,211 | A | 6/1992 | O'Brien et al. |
| 5,128,157 | A | 7/1992 | Ruiz |
| 5,145,091 | A | 9/1992 | Meyers |
| 5,150,720 | A | 9/1992 | Focke et al. |
| 5,192,386 | A | 3/1993 | Moir et al. |
| 5,195,637 | A | 3/1993 | Weder |
| 5,215,249 | A | 6/1993 | Gorrieri |
| 5,240,109 | A | 8/1993 | Weder et al. |
| 5,255,784 | A | 10/1993 | Weder et al. |
| 5,290,616 | A | 3/1994 | Cowan et al. |
| 5,301,804 | A | 4/1994 | Focke et al. |
| 5,307,988 | A | 5/1994 | Focke et al. |
| 5,311,992 | A | 5/1994 | Weder et al. |
| 5,316,211 | A | 5/1994 | Chang |
| 5,344,008 | A | 9/1994 | DeBlasio et al. |
| D351,104 | S | 10/1994 | Kapp |
| 5,358,171 | A | 10/1994 | Focke |
| 5,407,072 | A | 4/1995 | Weder et al. |
| 5,427,235 | A | 6/1995 | Powell et al. |
| 5,433,318 | A | 7/1995 | Focke |
| 5,435,439 | A | 7/1995 | Swart |
| 5,462,223 | A | 10/1995 | Focke et al. |
| D365,023 | S | 12/1995 | Abrams et al. |
| 5,489,060 | A | 2/1996 | Godard |
| 5,510,124 | A | 4/1996 | Kopecky et al. |
| 5,511,658 | A | 4/1996 | Focke et al. |
| 5,515,965 | A | 5/1996 | Boldrini et al. |
| 5,522,205 | A | 6/1996 | Weder |
| 5,553,773 | A | 9/1996 | Focke et al. |
| 5,556,026 | A | 9/1996 | Blankitny |
| 5,560,482 | A | 10/1996 | Katagiri et al. |
| 5,575,385 | A | 11/1996 | Zona |
| 5,607,056 | A | 3/1997 | Whiteside |
| 5,620,550 | A | 4/1997 | Andersson et al. |
| 5,632,378 | A | 5/1997 | Provost |
| 5,636,732 | A | 6/1997 | Gilels et al. |
| 5,732,823 | A | 3/1998 | Weder et al. |
| 5,738,207 | A | 4/1998 | Trimani |
| 5,783,266 | A | 7/1998 | Gehrke |
| 5,797,494 | A | 8/1998 | Balling et al. |
| 5,823,331 | A | 10/1998 | Manservigi et al. |
| 5,836,448 | A | 11/1998 | Weder |
| 5,855,434 | A | 1/1999 | Hagen |
| 5,860,524 | A | 1/1999 | Weder |
| 5,860,526 | A | 1/1999 | Burke, Jr. |
| 5,878,883 | A | 3/1999 | Weder |
| 5,924,571 | A | 7/1999 | Cornelissen |
| 5,941,641 | A | 8/1999 | Kinigakis et al. |
| 5,944,188 | A | 8/1999 | Grosskopf et al. |
| 5,992,621 | A | 11/1999 | Grant et al. |
| 5,996,797 | A | 12/1999 | Flaig |
| 6,001,397 | A | 12/1999 | Boyd et al. |
| 6,010,724 | A | 1/2000 | Boyd et al. |
| 6,026,953 | A | 2/2000 | Nakamura et al. |
| D421,568 | S | 3/2000 | Ferguson et al. |
| 6,044,848 | A | 4/2000 | Huang |
| 6,094,917 | A | 8/2000 | Sundhar et al. |
| 6,105,856 | A | 8/2000 | Kakiuchi |
| 6,164,444 | A | 12/2000 | Bray et al. |
| 6,199,687 | B1 | 3/2001 | Tambo et al. |
| 6,202,838 | B1 | 3/2001 | Tran |
| 6,220,430 | B1 | 4/2001 | Boriani et al. |
| 6,228,450 | B1 | 5/2001 | Pedrini |
| 6,237,760 | B1 | 5/2001 | Parker et al. |
| 6,309,105 | B1 | 10/2001 | Palumbo |
| 6,334,532 | B1 | 1/2002 | Tambo et al. |
| 6,395,317 | B1 | 5/2002 | Singh et al. |
| D465,416 | S | 11/2002 | Dzwill et al. |
| 6,478,149 | B1 | 11/2002 | Parker |
| 6,505,735 | B1 | 1/2003 | Parker |
| D471,804 | S | 3/2003 | Staples |
| D479,464 | S | 9/2003 | Kopecky |
| D479,646 | S | 9/2003 | Overton |
| 6,644,488 | B1 | 11/2003 | Coleman |
| D484,046 | S | 12/2003 | Kopecky |
| 6,709,684 | B2 | 3/2004 | Loth |
| 7,159,717 | B2 | 1/2007 | Aldridge et al. |
| 7,175,022 | B2 | 2/2007 | Ito |
| 7,467,711 | B2 | 12/2008 | Tambo |
| 7,527,189 | B2 | 5/2009 | Billig et al. |
| 7,533,773 | B2 | 5/2009 | Aldridge et al. |
| 8,016,105 | B2 | 9/2011 | Sendo |
| 2002/0063079 | A1 | 5/2002 | Loth |
| 2003/0034255 | A1 | 2/2003 | Luton et al. |
| 2003/0047470 | A1 | 3/2003 | Parker |
| 2003/0080020 | A1 | 5/2003 | Kopecky |
| 2003/0106928 | A1 | 6/2003 | Li Vigni et al. |
| 2005/0218198 | A1 | 10/2005 | Cavero et al. |
| 2006/0027483 | A1 | 2/2006 | Aldridge |
| 2007/0134371 | A1 | 6/2007 | Billig et al. |
| 2007/0138035 | A1 | 6/2007 | Fluegel et al. |
| 2007/0141199 | A1 | 6/2007 | Ishikawa et al. |

FOREIGN PATENT DOCUMENTS

| | | |
|---|---|---|
| DE | 9405638 | 6/1994 |
| DE | 10238905 | 3/2004 |
| EP | 0801000 | 10/1997 |
| EP | 1367005 | 12/2003 |
| EP | 1591027 | 11/2005 |
| EP | 1595807 | 11/2005 |
| FR | 762011 | 4/1934 |
| FR | 1204079 | 1/1960 |
| GB | 461794 | 2/1937 |
| GB | 808056 | 1/1959 |
| GB | 2074532 | 11/1981 |
| GB | 2078202 | 1/1982 |
| GB | 2227221 | 7/1990 |
| JP | 2-138584 | 11/1990 |
| JP | 07-099891 | 4/1995 |
| JP | 3022304 | 12/1995 |
| JP | 09-110072 | 4/1997 |
| JP | 11-1221 | 1/1999 |
| JP | 11-001120 | 6/1999 |
| JP | 11-227830 | 8/1999 |

(56) References Cited

FOREIGN PATENT DOCUMENTS

| | | |
|---|---|---|
| WO | 00/12407 | 3/2000 |
| WO | 01/07335 | 2/2001 |
| WO | 03/037744 | 5/2003 |
| WO | 2008/051813 | 5/2008 |

OTHER PUBLICATIONS

Mr. Brown Chewing Gum, Product Description, p. 1, http://www.gnpd.com, Feb. 7, 2000.

Third Party Observations, European Patent Office, Application No. 05768974.7, 11 pages, Dec. 15, 2009.

Notice of Opposition, European Patent Office, Application No. 05748373.7, 24 pages, Apr. 7, 2010.

GUM SLAB PACKAGE HAVING INSERTABLE PRODUCT RETENTION MEMBER

CROSS-REFERENCE TO RELATED APPLICATIONS

This application is a continuation of U.S. application Ser. No. 12/707,079, filed Feb. 17, 2010, which claims priority to U.S. application Ser. No. 11/124,906, filed May 9, 2005, now U.S. Pat. No. 7,811,614, which claims priority to U.S. Provisional Application No. 60/570,014, filed May 11, 2004; U.S. Provisional Application No. 60/569,926, filed May 11, 2004; U.S. Provisional Application No. 60/570,016, filed May 11, 2004; U.S. Provisional Application No. 60/570,019, filed May 11, 2004; U.S. Provisional Application No. 60/570,020, filed May 11, 2004; U.S. Provisional Application No. 60/570,017, filed May 11, 2004; and U.S. Provisional Application No. 60/570,129, filed May 11, 2004; which are incorporated herein by reference.

FIELD OF THE INVENTION

The present invention relates generally to a package for containing an array of consumable products and retaining the products in the package until such time as it is desired to dispense the individual products. More particularly, the present invention relates to a package for retaining and dispensing gum slabs having an insertable member for product retention.

BACKGROUND OF THE INVENTION it is well known to house consumable products such as gum slabs in a package or housing which retains the gum slabs and allows for dispensing of an individual slab therefrom. The gum slabs are typically arranged in an array, so that a single gum slab may be removed from the array leaving the remaining gum slabs in the package. Often, the gum slabs may be wrapped individually in an outer wrapper.

Certain of the gum slab packages are of the type which maintain their outer configuration even after removal of one of the gum slabs. This creates a space in the package which allows adjacent gum slabs to become displaced. Therefore, it may become difficult to remove additional gum slabs from the package if one or more of the remaining gum slabs tilts or fails over within the package. Also, by creating such a space, the remaining gum slabs may slide or move in the package and may even fall out of the package.

One attempt to retain and dispense individual gum slabs from a package is shown in U.S. Patent Application Publication No. 2003/0080020 to Kopecky, the disclosure of which is incorporated by reference herein for all purposes. The Kopecky publication discloses a gum slab package housing formed from a die cut paperboard blank having a generally rectangular configuration. The housing includes a front cover which opens to expose a plurality of gum slabs. The gum slabs are contained in a side-by-side array by a sheet which wraps around the gum slabs. The sheet, including the gum slab array, is placed into the package housing such that the gum slabs are exposed once the front cover is opened. In order to retain the gum slabs in an upright condition and maintain the gum slabs within the package once one or more of the slabs are removed from the array, the gum slabs are adhesively secured to the sheet. The adhesive securement may take the form of wax areas on the inner surface of the sheet. Once the wrapped slabs are inserted into the sheet, heat is applied to the sheet to cause the wax to melt. The array of gum slabs secured to the sheet may then be placed in the package for retention and dispensing.

While the device disclosed in the Kopecky publication attempts to provide a package which both allows for the retention and dispensing of gum slabs, it has been found that the package may not adequately perform over the long term. Accordingly, it is desirable to provide an improved gum slab package which allows for the retention and dispensing of individual gums and which will retain the remaining gum slabs in the package once one or more of the gum slabs are removed.

SUMMARY OF THE INVENTION

The present invention provides a package assembly for individual elongate consumable products. The package assembly includes a plurality of products aligned in a side-by-side array. A package housing encloses the array of products. The package housing includes a front wall, a back wall, and a closable cover for closing a dispensing opening. A frictional product retaining member is insertably supported within the package for frictionally retaining the array of products within the package.

In one preferred embodiment of the present invention, the frictional retention member is a band extending transversely around the product. The band frictionally retains the array of products. The band may be adhesively secured to the package. Each product of the array may include an individual wrapper. The wrapper is folded at at least one end to define an upwardly formed wrapper flap. The band defines a transverse edge extending along the array of products. The transverse edge of the band is engagable with the wrapper flap upon removal thereof to removably retain the products in the package. The wrapper flap is deflectable so as to permit removal of the product from the package.

In a further preferred embodiment, the frictional product retention member may include a corrugated insert supported within the package. The corrugated insert has a corrugated surface frictionally engagable with the product array to support the product array within the package. The corrugated insert may be adhesively attached to the package. In one example, the corrugated insert is U-shaped for frictionally supporting the array of products on both sides thereof.

In another embodiment of the present invention, a frictional retention member may include a U-shaped retention clip for supporting one end of the product array. The U-shaped retention clip is an elongate member having a bottom wall, opposed upstanding side walls and an inwardly diverging flared extent. The flared extent is urged inwardly between the walls of the package so as to retentively support the ends of the product in the clip.

A further embodiment of the U-shaped clip may include inwardly extending spring flaps which delectably engage the products for retentively supporting the products therebetween.

In a still further embodiment, the frictional retention member may include a louvered support member which is insertably retained within the package. The louvered support member includes a plurality of deflectable spring louvers cut from the support member for individually supporting the products of the array.

A further embodiment of the present invention provides a frictional retention member which includes a carrier insertably supported within the package. The carrier has a foldable front flap forming a U-shaped lower section for supporting one end of the products and a foldable upper section for foldable positioning over the other end of the products. The foldable upper section includes a plurality of tabs, each tab overlying an individual product. The tabs are separable from one another to dispense one product individually. Once the product is removed, the tab is repositionable between adjacent product. It is further contemplated that the tabs may be separated by perforations.

DETAILED DESCRIPTION OF THE PREFERRED EMBODIMENTS

The present invention is directed to a package assembly which contains a plurality of consumable products in a package housing. The package housing is openable to allow dispensing of one or more products therefrom and is reclosable to contain and maintain the products therein. While the present invention is useful with a wide of variety of consumable product, it is particularly useful with respect to elongate gum slabs which are arranged in a side-by-side array.

Consumable product packages of this type are disclosed in commonly assigned U.S. patent application Ser. No. 10/833,468 filed Jul. 1, 2004 entitled "Confectionery Packaging Design" and Ser. No. 11/025,739 filed Dec. 22, 2004 entitled "Gum Package Design with Two Separate Compartments", both of which are incorporated by reference herein for all purposes.

Moreover, the present invention discloses consumable product packages of the type shown in commonly assigned U.S. patent application Ser. No. 11/124,921, filed at even date herewith entitled "Gum Slab Package With Flap Retention", and also shown in commonly assigned U.S. patent application Ser. No. 11/124,922, filed at even date herewith entitled "Package For Dispensing And Retaining Gum Slabs With Adhesive Securement", both of which are incorporated by reference herein for all purposes.

Figure 1:
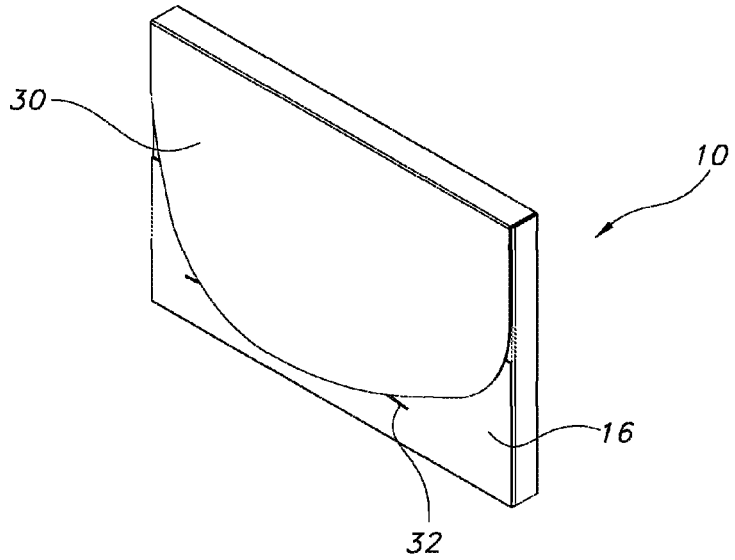
FIG. 1 is a perspective showing of the package assembly of the present invention in a closed condition.
Figure 2:
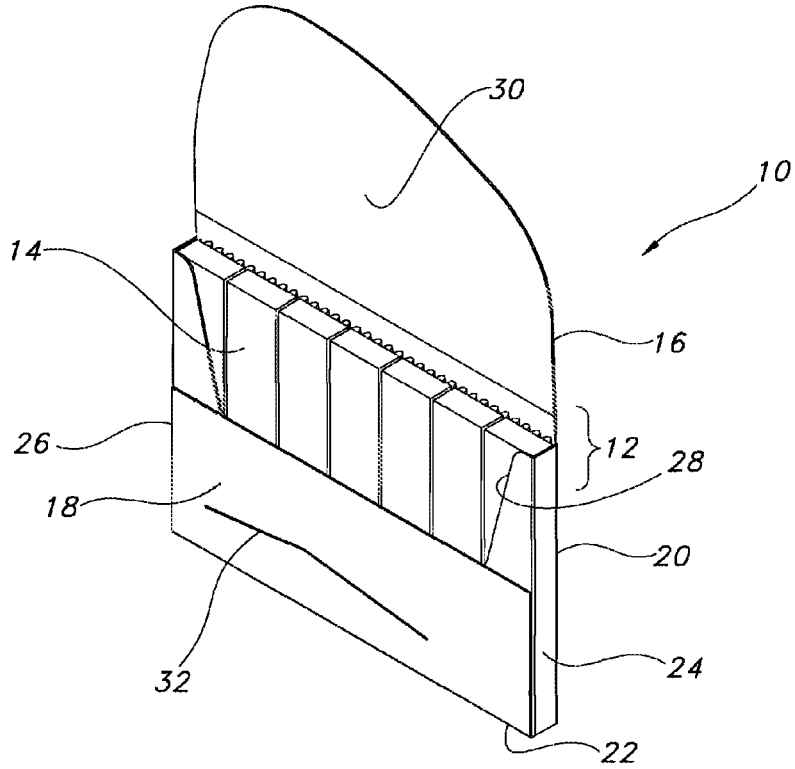
FIG. 2 is a perspective showing of the package assembly of FIG. 1 in an opened condition showing an array of products which may be dispensed from a dispensing opening.

Referring now to FIGS. 1 and 2, the present invention provides a packaging assembly 10 which supports therein an array 12 of gum slabs 14. Gum slabs 14 are typically elongate rectangularly shaped members which may optionally include wrappers (not shown in FIG. 2) individually around each gum slab. The gum slabs are arranged in a side-by-side fashion to form array 12. The gum slabs 14 are supported in the array in a package housing 16. The package housing 16 includes a front wall 18, an opposed back wall 20, a bottom wall 22, and opposed side walls 24 and 26. As will be described in further detail hereinbelow, the package housing is formed from die cut paperboard, which is folded in a well known manner to form the configuration shown in FIGS. 1 and 2. The package housing 16 is folded such that it provides an open upper end 28 which defines a dispensing opening. The back wall 20 includes an upwardly extending foldable cover 30 which may be folded over the open upper end to close the opening and contain the slabs 14 within the package housing 16. A slit 32 positioned in the front wall 18 allows the distal edge 34 of cover 30 to be inserted therein for reclosing purposes. Additionally, it is contemplated that the package is provided in the condition shown in FIG. 1 with the cover 30 adhesively secured to the front wall 18. Once the adhesive securement is removed to dispense the first gum slab, the flap may be reclosed by inserting it into the slit 32

It is also contemplated that the package housing 16 may be covered by a plastic wrap (not shown) which encloses and protects the package and during shipping and prior to sale and use.

As will be described in further detail hereinbelow, it is contemplated that the array 12 of slabs 14 will be removable retentively supported within the package housing 16 so that it permits easy removal of one or more gum slabs while maintaining the remainder of the gum slabs in the package housing. Furthermore, it is contemplated that the technique for releasably supporting the slabs 14 within the package housing will permit the slabs 14 to maintain their position within the housing even after removal of one or more of the adjacent gum slabs so as to prevent the gum slabs from tilting or falling over in the package or falling out from the package.

Figure 4:
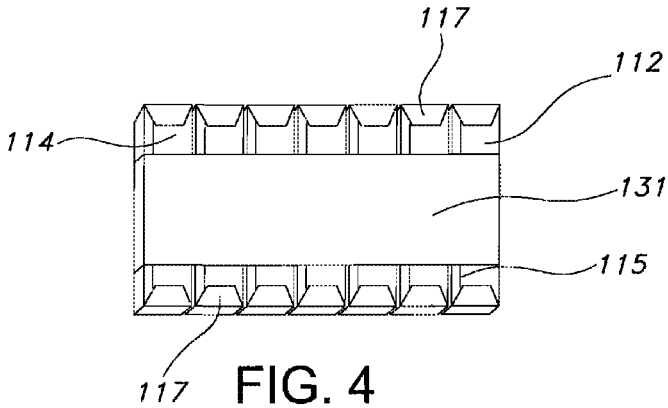
FIG. 4 shows an array of wrapped products of the type shown in FIG. 2 including a band about said products.
Figure 5:
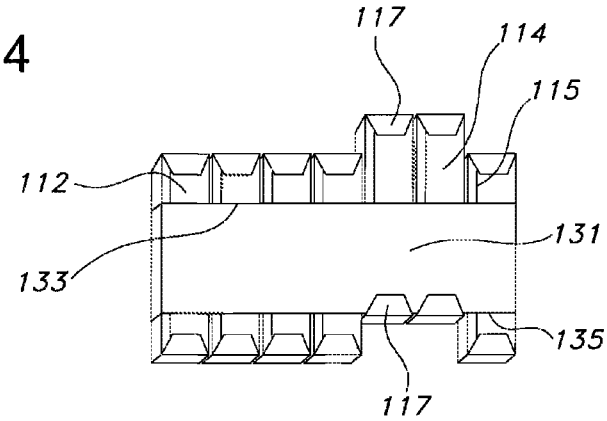
FIG. 5 shows the array of products of FIG. 4 with two products shown being positioned for removal with respect to said band.
Figure 3:
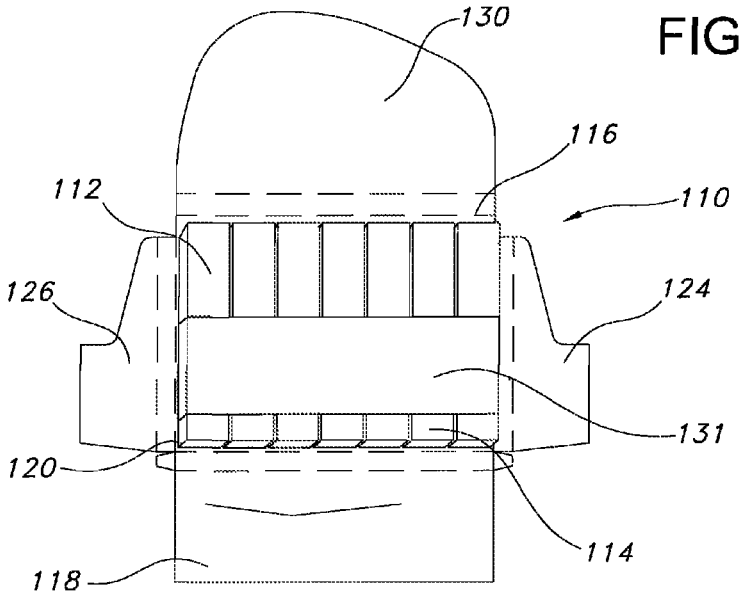
FIG. 3 shows one embodiment of the present invention wherein an array of products is surrounded with a band positioned within a package housing shown in its preassembled condition.

Referring now to FIGS. 3-5, one embodiment of present invention is shown. With respect to the present embodiment, similar reference numerals denote similar elements with 100 added to reference numerals of FIGS. 1 and 2 to denote the present embodiment.

FIG. 3 shows the package assembly 110 and the package housing 116 in its preassembled condition. The package housing 116 is formed from a die cut paperboard form which may be folded from its flat configuration shown in FIG. 3 into the configuration shown in FIGS. 1 and 2. The package housing includes a back wall 120, a foldable front wall 118, foldable side walls 124 and 126 and a foldable cover 130. The package housing 116 supports an array 112 of gum slabs 114 against the interior surface of back wall 120.

As shown more particularly in FIGS. 4 and 5 in the present illustrative embodiment, gum slabs 114 are wrapped guru slabs. Each gum slab 114 may be individually wrapped with a paper and/or foil wrapper 115 in conventional fashion. Wrapping in this manner provides a folded wrapper flap 117 at each end thereof. In the present embodiment, the wrapper flaps 117 are folded on the same side of the gum slab and mutually inwardly facing. The array of gum slabs are arranged such that wrapper flaps face the back wall 120 when the package housing is assembled.

The array 112 of gum slabs 114 are held in frictional mutual engagement by a transversely extending band 131. Band 131 may be formed of a wide variety of materials including paper, foil or combinations thereof. The band extends transversely about the array 112 of gum slabs 114 and along the longitudinal extent of the wrapped gum slabs 114 at a location which does not overlap wrapper flaps 117. The ends of band (not shown) may be sealed to each other in conventional fashion to completely encircle the array 112. The band 131 is positioned about the array 112 in such a fashion that it frictionally retains the wrapped gum slabs therein but allows for longitudinal movement therealong as shown in FIG. 5. The band 131 defines spaced apart transverse edges 133 and 135. Edge 135, for example, of band 131 serves as a retaining surface preventing the inadvertent removal of the individual gum slab 114 from the array 112.

As graphically shown in FIG. 5, in an attempt to remove or more of the gum slabs from the banded array, the wrapper flap will catch on the transverse edge 335 of band 331. While the wrapper flap is a folded flap, further upward movement of the individual wrapped gum slab 114 results in the wrapper flap unfolding so as to permit complete removal of the individual gum slab 114 from the banded array. The engagement between the folded wrapper flap 117 and the edge 135 of band 131 is sufficient to maintain the individual gum slabs within the band preventing inadvertent dislodgement therefrom even when adjacent gum slabs have been previously removed. Thus, after removal of one or of the gum slabs from the banded array, the remaining gum slabs will be retentively supported within the band 131.

Referring again to FIG. 3, the banded array of gum slabs is placed in the package housing 116 while the arrangement of the banded gum slabs is such that the wrapper flaps 117 face against back wall 12C. It may, of course, be appreciated that the banded array may be placed in the opposite direction with the folded flaps facing front wall 118.

It is contemplated that in order to support the banded array within package housing 116, band 131 may be adhesively secured to the back wall 120 of package assembly 116. Such adhesive securement would prevent movement of the band 131 within the housing 116. Thus, the band and its frictional engagement about the wrapped gum slabs 114 serves to retain the slabs 114 with the package 116. Furthermore, the ability of the transverse edge 335 to catch the wrapper flap 117 prevents inadvertent dislodgement of gum slabs 114 from the package.

Figure 6:
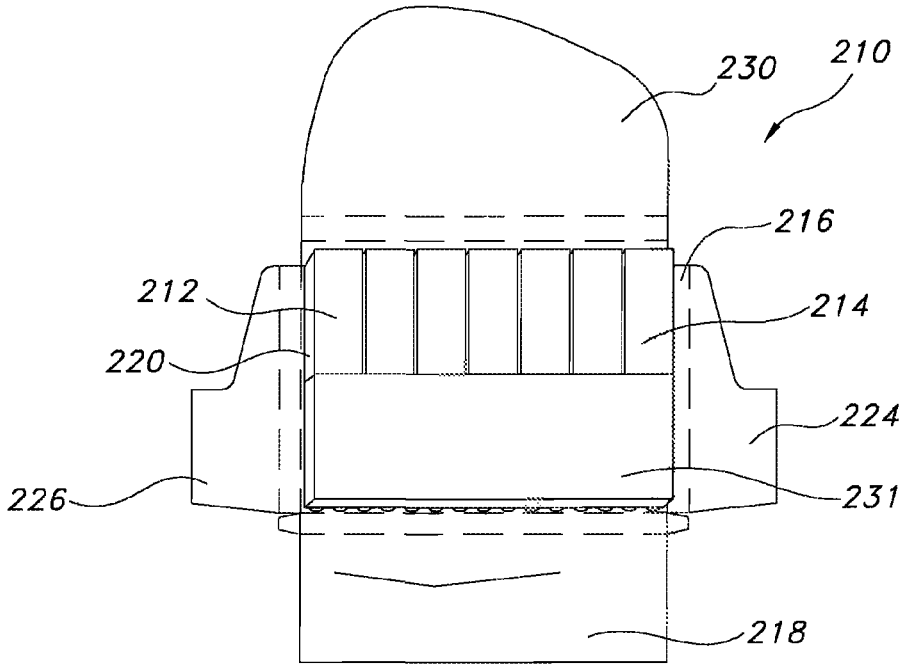
FIG. 6 shows a further embodiment of the present invention wherein an array of products are supported within, a package housing shown in its preassembled condition.
Figure 7:
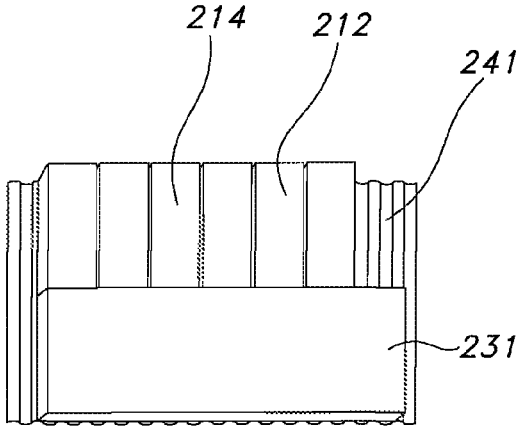
FIGS. 7 and 8 show further details of the packaging assembly of FIG. 6.
Figure 8:
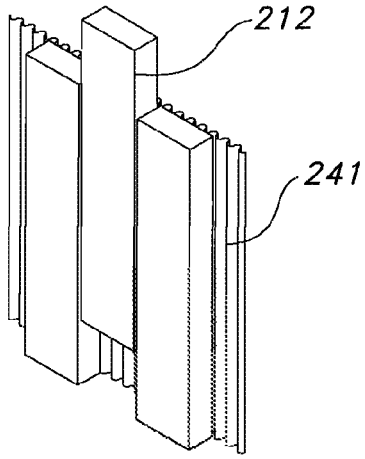

Referring now to FIGS. 6-8, a further embodiment of the present invention is shown. With respect to the present embodiment, similar reference numerals denote similar elements with 200 being added to the reference numerals of FIGS. 1 and 2 to denote the present embodiment.

FIG. 6 shows the package assembly 210 with the package housing 216 in its preassembled condition. The package housing 216 is formed from a die cut paperboard form which may be folded from its flat configuration shown in FIG. 6 into the configuration shown in FIGS. 1 and 2. The package housing includes a back wall 220, a foldable front wall 218, foldable side walls 224 and 226 and a foldable cover 230. The package housing 216 supports an array 212 of gum slabs 214 against the interior surface of back wall 220. In the present invention, the gum slabs 214 are unwrapped gum slabs. However, the present embodiment contemplates also using wrapped gum slabs.

In the present illustrative embodiment, the gum slabs 212 may be supported in a band 331. The band 231 is in the form of a U-shaped member which supports the array 214 of gum slabs 212 such that the upper ends thereof are exposed for dispensing. The band 231 may be formed of a wide variety of conventional materials such as paper, foil or combinations thereof. The U-shaped band defines opposed side walls, front and back walls, and a bottom wall.

The package assembly 210 of the present embodiment also includes, as particularly shown in FIGS. 7 and 8, a micro-fluted corrugated backer board 241. Backer board 241 is an undulating member defining a micro-fluted structure. The backer board 241 is positioned against the inside surface of back wall 120 and secured thereto by an adhesive or the like. The array 214 of products 212 contained within U-shaped band 231 is placed against the micro-fluted backer board 241 such that when the housing 216 is assembled, the fluted structure of the backer board 241 exerts a holding force or pressure against the individual gum slabs 212. Such a retention force is provided by the undulating structure of backer board 241. As can be appreciated from the depiction of FIG. 8, an individual gum slab 112 may be removed from the array. Once removed, the pressure exerted by the corrugated backer board 241 tends to maintain the remaining gum slabs 212 in an upright and retained position within the package housing 216. This is by virtue of the friction between the micro-fluted corrugated backer board 241 and the front wall 218 of the assembled package housing 216. Thus, the gum slabs will remain in place within the package 216 even where an adjacent gum slab has been previously removed.

Figure 9:
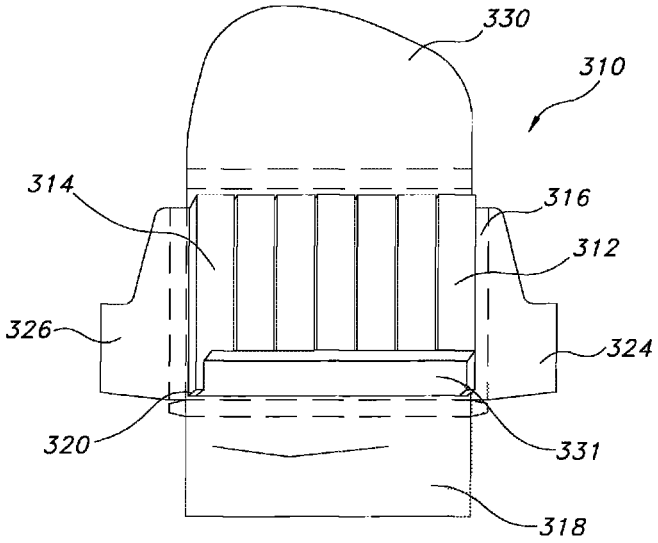
FIG. 9 shows a further embodiment of the present invention wherein an array of products are supported within a clip within the package housing shown in its preassembled condition.
Figure 10:
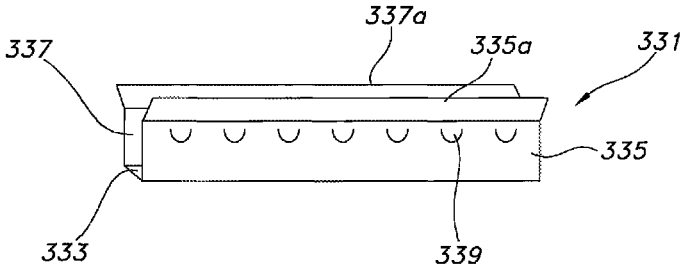
FIG. 10 is a perspective showing of the clip of FIG. 9.

Referring now to FIGS. 9 and 10, a still further embodiment of the present invention is shown. With respect to the present embodiment, similar reference numerals denote similar elements with 300 being added to the reference numerals of FIGS. 1 and 2 to denote the present embodiment.

FIG. 9 shows the package assembly 310 within the package housing 316 in its preassembled condition. The package housing 316 is formed from a die cut paperboard form which may be folded from its flat configuration shown in FIG. 9 into the configuration shown in FIGS. 1 and 2. The package housing includes a back wall 320, a foldable front wall 318, foldable side walls 324 and 326 and a foldable cover 330. The package housing 316 supports an array 312 of gum slabs 314 against the interior surface of back wall 320. In the present illustrative embodiment, gum slabs 314 are unwrapped gum slabs. However, wrapped gum slabs may also be employed in the present invention.

The gum slabs 314 are maintained in the array by use of a clip 331 shown in further detail in FIG. 10. Clip 331 is an elongate generally U-shaped member which may be formed of a wide variety of materials including resilient plastic material such as PVC. Clip 331 includes a planar bottom wall 333, a pair of opposed side walls 335 and 337 which extend upwardly from bottom wall 333 to provide a U-shaped configuration. Upper extents 335*a* and 337*a* of side walls 335 and 337 are outwardly flared. This outward flaring provides a lead-in so that the lower ends of the gum slabs 314 may be inserted thereinto. Side walls 335 and 337 of clip 331 may also include die cut elements 339 which may be inwardly deflected so as to engage the gum slabs 312 to help secure the gum slabs 312 in the clip.

The clip is formed to have a resilient memory so that the side walls impart a resilient holding force against the gum slabs inserted therein. Moreover, the clip 331 is supported in the package housing 316 in such a manner that when the package housing is assembled by upwardly folding front wall 318, the walls 335 and 337 will be further pushed inwardly as a result of the outwardly flared upward extents 335*a* and 337*a*. This further retentively holds the gum slabs in place. Thus, upon removing one of the gum slabs 314 from the array 312, the remaining gum slabs will be retentively supported within the clip and thereby in the package housing 316.

It is further contemplated that the clip 331 may be adhesively secured within the package housing 316 by a suitable adhesive.

Figure 11:
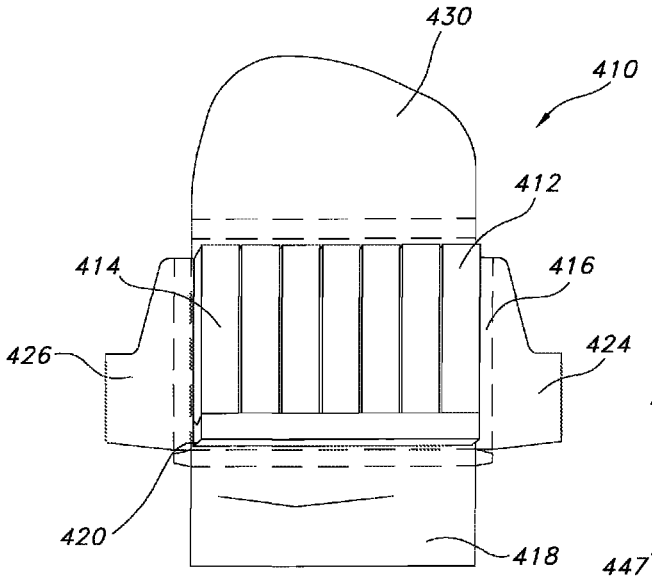
FIG. 11 is a further embodiment of the present invention wherein an array of products are supported within a further embodiment of a clip positioned within a package housing shown in its preassembled condition.
Figure 12:
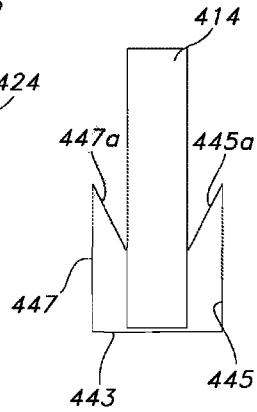
FIG. 12 is a side plan view of the products contained within the clip of FIG. 11.
Figure 13:
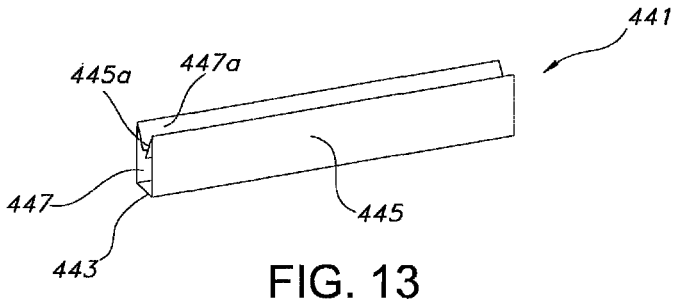
FIG. 13 is a perspective showing of the clip of FIG. 11.

Referring now to FIGS. 11-13, yet another embodiment of the present invention is shown. With respect to the present embodiment, similar reference numerals denote similar elements with 400 being added to the reference numerals of Figures and 2 to denote the present embodiment.

FIG. 11 shows the package assembly 410 with the package housing 416 in its preassembled condition. The package housing 416 is formed from a die cut paperboard form which may be folded from its flat configuration shown in FIG. 11 into the configuration shown in FIGS. 1 and 2. The package housing includes a back wall 420, a foldable front wall 418, foldable side walls 424 and 426 and a foldable cover 430. The package housing 416 supports an array 412 of gum slabs 414 against the interior back surface of back wall 420. In the present illustrative embodiment, unwrapped gum slabs are shown. However, the present invention also contemplates use of wrapped gum slabs. The lower ends of the gum slabs 414 may be supported in a support member 441 shown more fully in FIGS. 12 and 13.

Support member 441 is in the form of a U-shaped clip. The support member 441 may be formed of paperboard or similar materials. The member 441 includes a bottom wall 443, opposed side walls 445 and 447 which extend upwardly from bottom wall 443. Member 441 includes a pair of inwardly directed side wall flaps 445*a* and 447*a* extending respectively from side walls 445 and 447. As particularly shown in FIG. 12, side wall flaps 445*a* and 447*a* bear against gum slabs 414 to retentively hold the gum slabs within the support member 441. These flaps exert a spring force against the gum slabs which permits removable retention thereof. Furthermore, once the package assembly 416 is assembled with front wall 418 being folded upwardly, the folded package maintains the side walls 445 and 447 in a vertical condition thus maintaining the spring bias engagement of the side wall flaps 445*a* and 447*a* against the gum slabs 414. Thus, one or more gum slabs may be removed from the package housing 416 with the remaining gum slabs remaining in place.

It is further contemplated that the U-shaped member 441 may be adhesively secured within the package housing 416.

Figure 14:
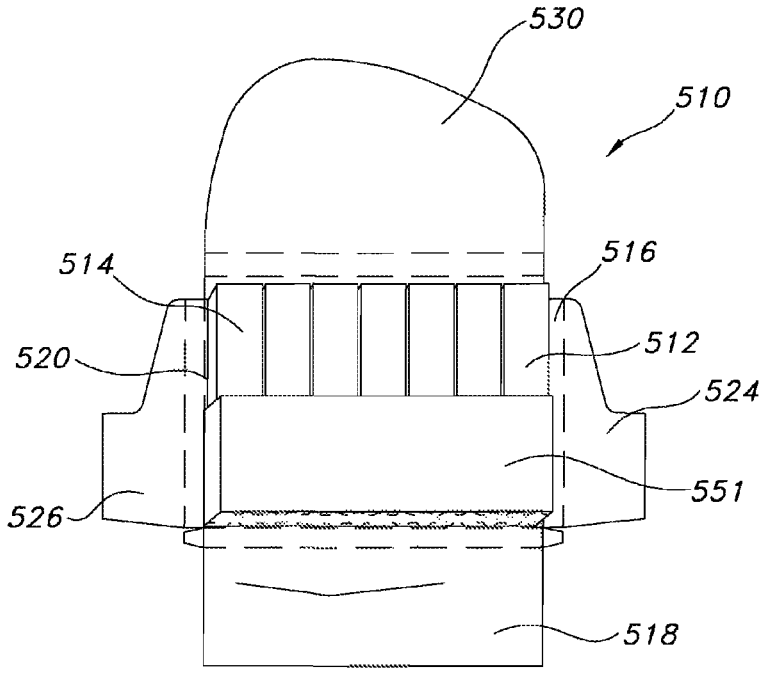
FIG. 14 shows a further embodiment of the present invention where an array of products are supported within a package housing shown in the preassembled condition.
Figure 15:
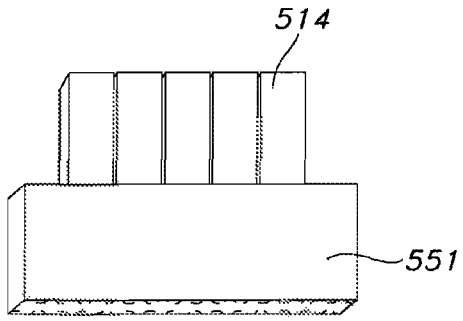
FIGS. 15 and 16 show further details of the assembly of FIG. 14 for retaining an array of products.
Figure 16:
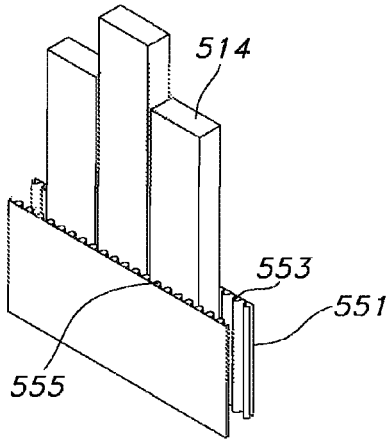

Referring now to FIGS. 14-16, another embodiment of the present invention is shown. With respect to the present embodiment, similar reference numerals denote similar elements with 500 being added to the reference numerals of FIGS. 1 and 2 to denote the present embodiment.

FIG. 14 shows a package assembly 510 with the package housing 516 in its preassembled condition. The package housing 516 is formed from a die cut paperboard form which may be folded from its flat configuration shown in FIG. 14 into the configuration shown in FIGS. 1 and 2. The package housing includes a back wall 520, a foldable front wall 518, foldable side walls 524 and 526 and a foldable cover 530. The package housing 516 supports an array 512 of gum slabs 514 against the interior surface of back wall 520. In the present illustrative embodiment, unwrapped gum slabs 514 are shown. However, the present invention contemplates use of wrapped gum slabs.

The gum slabs 514 are further contained within a support member 551 shown more fully in FIGS. 15 and 16. The support member 551 may be a U-shaped member as shown in FIG. 15 or may be formed of two spaced apart planar members as shown in FIG. 16. Support member 551 includes inwardly facing side walls 553 and 555 each of which define a micro-fluted corrugated surface. The gum slabs 514 are supported between the corrugated surfaces 553 and 555 as shown in FIGS. 15 and 16. The corrugated surfaces serve to frictionally hold the gum slabs therebetween. The micro-fluted configuration of the corrugated surfaces exert a pressure on the gum slabs, especially when the surfaces are supported within the assembled package housing 516. The retentive frictional engagement provided by the corrugated surfaces 553 and 555 is sufficient to removably retentively support the gum slabs so that once one or more gum slabs are removed from the array the remaining gum slabs will be held upright in place by the corrugated surfaces.

It is further contemplated that the support member 551 may be adhesively secured in the package 516 upon assembly.

Figure 17:
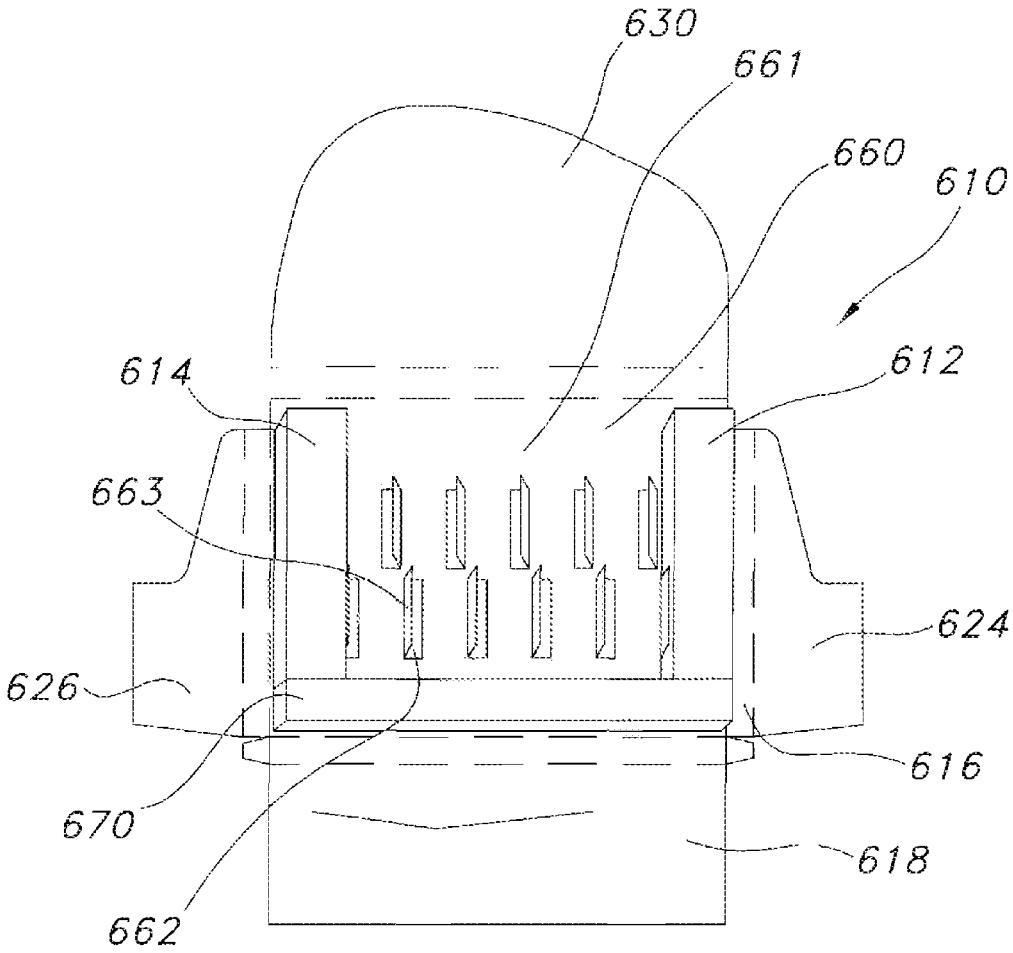
FIG. 17 shows a further embodiment of the present invention where individual products are supported within a package housing shown in a preassembled condition.

Turning now to FIG. 17, a further embodiment of the present invention is shown. With respect to the present embodiment, similar reference numerals denote similar elements with 600 being added to the reference numerals of FIGS. 1 and 2 to denote the present embodiment.

FIG. 17 shows the package assembly 610 with package housing 616 in its preassembled condition. The package housing 616 is formed from a die cut paperboard form which may be folded from its flat configuration shown in FIG. 17 into the configuration shown in FIGS. 1 and 2. The package housing includes a back wall 620, a foldable front wall 618, foldable side walls 624 and 626 and a foldable cover 630. The package housing 616 supports an array 612 of gum slabs 614 therein. For clarity purposes, only two slabs 614 of array 612 are shown in FIG. 17. In the present illustrative embodiment, gum slabs 614 are unwrapped gum slabs. However, the present invention contemplates use of wrapped gum slabs.

As shown in FIG. 17, package assembly 610 further includes a die cut louvered support member 660. The louvered support member 660 is formed of paperboard and is a planar element 661 having a plurality of spaced apart rectangular die cut openings 662 formed therethrough. The die cut openings 662 are cut on three sides so that a remaining longitudinal extent allows cut portion 663 to be folded out from planar member 661. The cut portion 663 forms louvered spring elements, which when folded support individually the gum slabs 614. These cut portions 663 may be arranged in two rows where each cut portion of one row is offset from the cut portion of the other row. The gum slabs 614 may be supported between two longitudinally adjacent cut members of the two rows.

The cut portions 663 serve as spring members to retain the gum slabs in place. Each gum slab can therefore be removed individually without effect on the retention of the remaining gum slabs by the louvered support member 660. Thus, when front wall 618 is folded to form package housing 616, the louvered support member retentively supports the array 612 of gum slabs 614 within the package 660. The louvered support member 660 including the array 612 of gum slabs 614 may be supported by a end member 670 at one end thereof.

It is further contemplated that the support member 660 may be adhesively secured to the back wall 620 of package housing 616.

Figure 19:
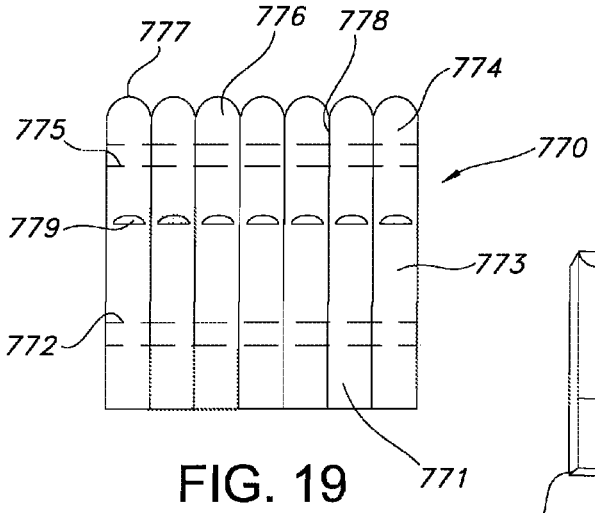
FIGS. 19 and 20 show further details of the assembly of FIG. 18.
Figure 20:
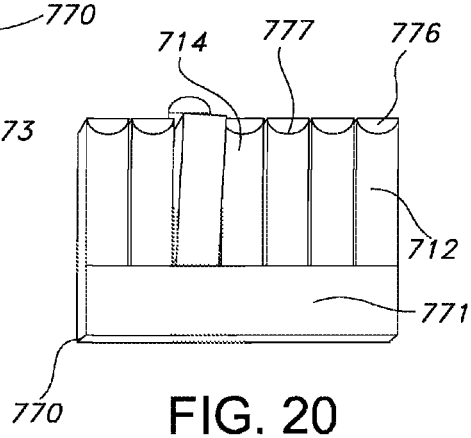
Figure 18:
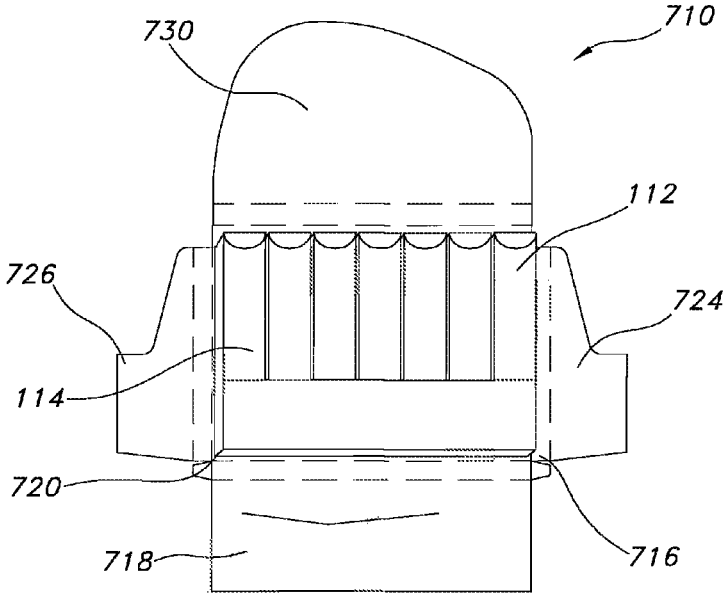
FIG. 18 shows a further embodiment of the present invention where an array of products are supported within a package housing shown in its preassembled condition.

Referring now to FIGS. 18-20, a still further embodiment of the present invention is shown. With respect to the present embodiment, similar reference numbers denote similar elements with 700 being added to the reference numerals of FIGS. 1 and 2 to denote the present embodiment.

FIG. 18 shows the package assembly 710 with the package housing 716 in its preassembled condition. Package housing 716 is formed from a die cut paperboard form which may be folded from its flat configuration shown in FIG. 18 into the configuration shown in FIGS. 1 and 2. Package housing 716 supports an array 712 of gum slabs 714 against the interior surface of back wall 720. The package housing includes a back wall 720, a foldable front wall 718, foldable side walls 724 and 726 and a foldable cover 730. In the present illustrative embodiment, gum slabs 714 are unwrapped gum slabs. However, the present invention contemplates use of wrapped gum slabs.

Gums slabs 714 are further contained within a die cut paperboard carrier 770. The paperboard carrier 770, shown in its flat configuration in FIG. 19, includes a foldable bottom flap 771 which is folded along score lines 772. Carrier 770 has a back wall 773 against which the gum slabs are placed. The back wall 773 of die cut member 770 also includes a plurality of slots 779 therealong.

The carrier further includes a foldable top flap 774 which is folded along score lines 775. The foldable top flap 774 is divided into a plurality of individual tabs 776 having rounded ends 777. The individual tabs 776 are separated by perforations 778 therebetween.

FIG. 20 shows carrier 770 supporting the array 712 of gum slabs 714. The front flap 771 engages one surface of the array while the back wall 773 engages the opposite surface. The top flap 774 is folded about the top of the gum slabs 714 so that the rounded ends 777 of tabs 776 overlie the front of the gum slabs 714.

As shown in FIGS. 18 and 19, the gum slabs 714 contained with in the carrier 770 are positioned within the package housing 716. It is contemplated that the carrier may be adhesively supported to the back wall 720 of package housing 716. The arrangement of the die cut carrier 770 in the package housing 716 retentively supports the individual gum slabs 714 therein. In order to remove one gum slab 714, the associated tab 776 is lifted so that it separates from the adjacent tabs by virtue of the perforations 778 therebetween. With the tab 776 lifted, the individual gum slabs 714 may be removed. Thereafter, the tab 776 is folded back down and the rounded distal end 777 may be inserted to the associated slot 779 by locating the tab in slot after removal of the associated gum slab. The positioning of the tab 776 in the slot 779 results in the adjacent gum slabs being held in place preventing tilting thereof.

Having described the preferred embodiments herein, it should now be appreciated that variations may be made thereto without departing from the contemplated scope of the invention. Accordingly, the preferred embodiments described herein are deemed illustrative rather than limiting, the true scope of the invention being set forth in the claims appended hereto.

What is claimed is:

1. A package assembly for individual elongate consumable products comprising:

a plurality of said products aligned in a side-by-side array;

a package housing for enclosing said array of products, said package housing having a front wall, a back wall and a closeable lid for closing a dispensing opening;

a frictional product retention member insertably supported within said package for frictionally retaining said array of products within said package;

wherein said frictional product retention member includes a carrier insertably secured in said package, said carrier having a foldable front flap forming a U-shaped lower section for supporting one end of said products and a foldable upper section for foldable positioning over the other end of said products wherein said foldable upper section includes a plurality of tabs overlying each product, said tabs being separable from one another to dispense one of said products and each of said tabs is re-positionable between adjacent products upon removal of one of said products of said array.

2. A package assembly of claim 1 wherein said tabs are separated by perforations.

* * * * *